United States Patent [19]

Seely et al.

[11] Patent Number: 4,893,098

[45] Date of Patent: Jan. 9, 1990

[54] 90 DEGREE BROADBAND MMIC HYBRID

[75] Inventors: Warren L. Seely; Joseph Staudinger, both of Chandler, Ariz.

[73] Assignee: Motorola, Inc., Schaumburg, Ill.

[21] Appl. No.: 280,094

[22] Filed: Dec. 5, 1988

[51] Int. Cl.[4] ..... H01P 5/18

[52] U.S. Cl. ..... 333/112; 333/118

[58] Field of Search ..... 333/100, 112, 118, 124, 333/23, 138, 109, 117, 119, 131

[56] References Cited

U.S. PATENT DOCUMENTS

| | | | |
|---|---|---|---|
| 1,211,822 | 1/1917 | Chernyshoff | 333/23 X |
| 3,048,798 | 8/1962 | Simons | 333/112 |
| 3,484,724 | 12/1969 | Podell | 333/112 |
| 3,539,948 | 11/1970 | Salzberg | 333/112 |
| 3,555,461 | 1/1971 | Ralph et al. | 333/23 X |
| 4,216,446 | 8/1980 | Iwer | 333/112 |
| 4,556,856 | 12/1985 | Presser | 333/124 |

FOREIGN PATENT DOCUMENTS

| | | | |
|---|---|---|---|
| 151784 | 8/1985 | European Pat. Off. | 333/112 |

OTHER PUBLICATIONS

Higgins, *Low Frequency Directional Couplers,* Electrical Communicator, Jul./Aug. 1967, pp. 3, 4.

*Primary Examiner*—Paul Gensler

*Attorney, Agent, or Firm*—Jordan C. Powell

[57] ABSTRACT

A 90 degree hybrid is contemplated having three parallel signal paths, one of the signal paths is a central signal path which provides direct impedence to ground. The other two signal paths are capacitively coupled to the central signal path to provide a second impedence. Each signal path incorporates at least one inductor coupled in series along each of the signal paths. The signal paths are capacitively coupled to each other at each end of the inductors. To increase the bandwidth, additional hybrids are coupled in series, with each hybrid forming a section of the broadband hybrid.

4 Claims, 1 Drawing Sheet

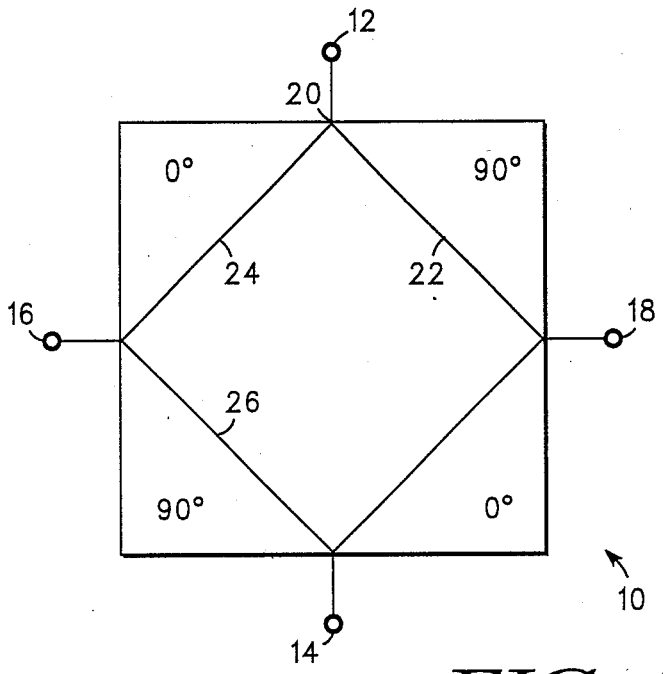
FIG. 1
FIG. 2
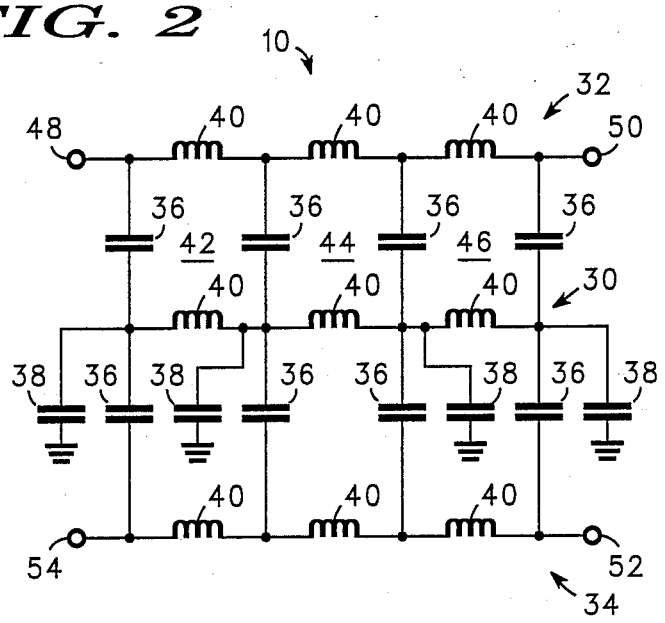

90 DEGREE BROADBAND MMIC HYBRID

BACKGROUND OF THE INVENTION

This invention relates, in general, to microwave hybrids for use in Monolithic Microwave Integrated Circuits (MMIC) technology, and more specifically, to 90 degree broadband hybrids.

Broadband 90 degree hybrids are basic components in analog microwave systems and are used when a RF input signal is to be divided into equal amplitude signals that differ in phase by 90°. The split signals are directed to two output ports.

Current microwave 90 degree hybrids are generally made using distributed methods, such as the Lange or De Ronde couplers. These, and other current methods for developing 90 degree hybrids, are not easily adapted to use in MMIC technology. MMIC circuits utilize gallium Arsenide (GaAs) which only allows for extremely small circuit areas, and cannot utilize ferrite in construction of the circuit. Therefore, the current technology is not usuable in MMIC's, or is limited to very high frequencies (above 25 GHz). Furthermore, existing MMIC lumped element 90 degree hybrids have narrow bandwidths (less than 5%).

SUMMARY OF THE INVENTION

Accordingly, it is an object of the present invention to provide an 90 degree hybrid which can be easily incorporated into MMIC technology.

Another object of the present invention is to provide a 90 degree hybrid which has broad band widths and large frequency ranges in the lower $GH_z$ frequencies for MMIC circuits.

Accordingly, a 90 degree hybrid is contemplated having three parallel signal paths, one of the signal paths is a central signal path which provides direct impedance to ground. The other two signal paths are capacitively coupled to the central signal path to provide a second impedance. Each signal path incorporates at least one inductor coupled in series along each of the signal paths. The signal paths are capacitively coupled to each other at each end of the inductors. To increase the bandwidth, additional hybrids are coupled in series, with each hybrid forming a section of the broadband hybrid.

The above and other objects, features, and advantages of the present invention will be better understood from the following detailed description taken in conjunction with the accompanying drawings.

BRIEF DESCRIPTION OF THE DRAWING

FIG. 1 is a schematic diagram of the operation of a broadband 90 degree microwave hybrid according to the present invention.

FIG. 2 is a schematic diagram of the circuit for a preferred embodiment of a broadband 90 degree microwave hybrid according to the present invention.

DETAILED DESCRIPTION OF THE INVENTION

FIG. 1 reflects the operation of a 90° hybrid 10. Hybrid 10 has four ports 12, 14, 16, and 18. For explanation purposes, assume port 12 is an input port, with ports 16 and 18 as output ports, and port 14 as an isolation port. As an RF signal is input into input 12, the RF signal is split at node 20 into signals equal in amplitude. A first portion of the signal is then shifted in phase by an amount $\phi+90°$ as illustrated by 90° phase shift line 22, and output through output 18. The second portion of the signal is shifted in phase an amount $\phi$ as indicated by 0° phase shift line 24, and output through output 16. It should be recognized that each port can be an input port, output port, or isolation port. For instance, if the RF signal is input at port 16, at a given point in time port 14 outputs the $\phi+90°$ phase shifted signal, port 12 outputs a signal phase shifted $\phi$, and port 18 acts as an isolation port.

Hybrid 10 is shown in a preferred schematic diagram in FIG. 2. Hybrid 10 is shown as a three section broadband hybrid for explanation purposes. However, it should be understood that hybrid 10 may comprise one or more sections, depending upon the desired bandwidth. Additional sections increase the bandwidth of hybrid 10, with the increase in band width decreasing exponentially with each additional section. Therefore, an optimum number of sections would be between 3 and 5 sections.

As shown, hybrid 10 comprises a central signal path 30, and a second and third signal path 32 and 34 respectively. Signal paths 32 and 34 each are capacitively coupled to central signal path 30 through plurality of capacitors 36. Central signal path 30 is capacitively coupled to ground through plurality of ground capacitors 38.

Signal paths 30, 32, and 34 each comprise a plurality of inductors 40 coupled in series. In particular, hybrid 10 is comprised of three similar sections 42, 44, and 46, each respective section having one of the plurality of inductors 40 coupled along each signal path. One each of the plurality of capacitors 36 is coupled to each end of each of the plurality of inductors 40 along signal paths 30 and 32 to capacitively couple the two signal paths together, and to an end of each of the plurality of inductors 40 along signal paths 30 and 34 to capacitively couple signal paths 30 and 34 together. One each of the ground capacitors 38 couple each end of the plurality of inductors 40 along central signal path 30 to ground.

Signal path 32 is coupled on one end to port 48, and on the opposite end of signal path 32 to port 50. Similarly, signal path 34 is coupled on one end to port 52, and on the opposite end of signal path 34 to port 54. All ports are operational as input ports, output ports, and as isolation ports. For example, if an RF signal were input at port 48, port 50 would output a signal shifted in phase $\phi$, port 52 would output a signal shifted in phase $\phi+90°$, and port 54 would operate as an isolation port.

It will be recognized that plurality of inductors 40, plurality of capacitors 36, and plurality of ground capacitors 38 may be, and in the case of the preferred embodiment, are, lumped elements. By using lumped elements in the circuit design, the entire circuit may be constructed in a very small area. This allows hybrid 10 to be easily incorporated in MMIC technology.

Thus it is apparent that there has been provided, in accordance with the invention, a 90° hybrid that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A four terminal broadband 0/90 degree hybrid comprising:

a plurality of signal path means for transforming the impedance and phasing of an input signal;

a first of said signal path means capacitively coupled to an electric ground to form a central signal path;

said central signal path means for providing an impedance to said ground;

a second and third of said signal path means having ends providing the terminals of the 0/90 degree hybrid coupled to said central signal path through a plurality of capacitance means; and said plurality of capacitance means for providing an impedance to said central signal path from said second and third signal path means.

2. A four terminal broadband 0/90 degree hybrid according to claim 1 wherein each of said signal path means comprises:

at least one inductance means coupled along said signal path means.

3. A four terminal broadband 0/90 degree hybrid according to claim 2 wherein at least one of said inductance means comprises an inductor.

4. A four terminal broadband 0/90 degree hybrid according to claim 1 wherein each of said plurality of capacitance means comprises a capacitor.

* * * * *